United States Patent [19]

Neiditch et al.

[11] Patent Number: 4,497,718

[45] Date of Patent: Feb. 5, 1985

[54] HOMOGENEOUS AQUEOUS FABRIC SOFTENING COMPOSITION WITH STILBENE SULFONIC ACID FLUORESCENT WHITENER

[75] Inventors: Oscar W. Neiditch, Fair Lawn; Edmund S. Hurdle, North Bergen; Daniel J. Fox, Hawthorne, all of N.J.

[73] Assignee: Lever Brothers Company, New York, N.Y.

[21] Appl. No.: 486,624

[22] Filed: Apr. 20, 1983

[51] Int. Cl.[3] ..... D06L 3/12; D06M 13/38; D06M 13/46

[52] U.S. Cl. ..... 252/8.75; 252/8.8; 252/543; 252/547; 252/548; 252/DIG. 14

[58] Field of Search ..... 252/8.75, 8.8, 543, 252/547

[56] References Cited

U.S. PATENT DOCUMENTS

| | | | |
|---|---|---|---|
| 2,765,239 | 10/1956 | Siegrist | 252/543 |
| 2,937,997 | 5/1960 | Crounse | 252/117 |
| 2,980,625 | 4/1961 | Crounse | 252/543 |
| 3,714,151 | 1/1973 | Lyness | 260/240 CA |
| 3,870,647 | 3/1975 | Travers | 252/118 |
| 3,904,533 | 9/1975 | Neiditch et al. | 252/8.8 |
| 3,953,380 | 4/1976 | Sundby | 252/543 |
| 3,959,157 | 5/1976 | Inamorato | 252/8.8 |
| 3,997,453 | 12/1976 | Wixon | 252/8.75 |
| 4,140,641 | 2/1979 | Ramachandran | 252/8.75 |
| 4,202,800 | 5/1980 | Ciko et al. | 252/543 |
| 4,233,164 | 11/1980 | Davis | 252/8.8 |
| 4,233,167 | 11/1980 | Sramek | 252/8.75 |
| 4,239,659 | 12/1980 | Murphy | 252/524 |
| 4,320,013 | 3/1982 | Lohman | 252/8.8 |

FOREIGN PATENT DOCUMENTS

| | | | |
|---|---|---|---|
| 1380705 | 1/1975 | United Kingdom . | |
| 1508425 | 4/1978 | United Kingdom | 252/8.8 |

OTHER PUBLICATIONS

Stensby, Per. S.: "Optical Brighteners in Fabric Softeners", *Soap & Chem. Spec.*, 41, No. 5, pp. 85–88, May 1965.

*Primary Examiner*—Dennis L. Albrecht
*Attorney, Agent, or Firm*—Milton L. Honig; James J. Farrell

[57] ABSTRACT

The invention provides a composition and method wherein fluorescent whitening agents are satisfactorily dispersed in fabric softening compositions and viscosity stability of the composition is achieved. The fabric softening and whitening composition comprises:

(i) from about 0.5% to about 10% of a cationic surfactant;

(ii) from about 0.001% to about 0.3% of a stilbene sulfonic acid fluorescent whitening agent;

(iii) from about 0.001% to about 0.5% of a non-ionizable base; and (iv) deionized water.

The method for preparing the fabric softening system comprises forming an organic premix of fabric softening cationic surfactant, stilbene sulfonic acid fluorescent whitening agent and non-ionizable base. The organic premix is then added to deionized water containing other fabric softening adjuncts including an acidic pH adjusting agent to obtain pH of 3–6, the combination being stirred to uniformly disperse all components.

13 Claims, No Drawings

HOMOGENEOUS AQUEOUS FABRIC SOFTENING COMPOSITION WITH STILBENE SULFONIC ACID FLUORESCENT WHITENER

BACKGROUND OF THE INVENTION

1. Field of the Invention

The invention relates to a fabric softening composition containing fluorescent whitening agents readily dispersible within the cationic surfactant phase and methods for their preparation and use.

2. The Prior Art

Liquid rinse cycle fabric softeners rehabilitate the softness of garments harshened during the washing process. Most commercially available fabric softeners use tallow based quaternary actives. They deposit onto the garments to provide a soft tactile feel. Unfortunately, quaternary actives also leave a yellowish cast on the fabrics. Laundry is left looking old and dingy. Science has learned to solve the problem. Whiteness/brightness can be restored through fluorescent whitening agents directly incorporated into the softening product.

Commercial whitening agents are complex organic molecules existing in either the acid or alkali metal salt form. Neither form can be conveniently incorporated into typical fabric softener systems. These systems have two phases—water and quaternary active phases. Salt forms of fabric whitening agents (FWA) are only moderately dispersible in the quaternary active phase. The salt forms dissociate in the fabric softener system. Dissociated electrolytes migrate into the water phase. As electrolyte content increases, the fabric softener system viscosity decreases. Watery products resulting therefrom are aesthetically unpleasing. Long term stability is also adversely affected.

When salt forms of the FWA are placed directly into the water phase, they are initially soluble. However, upon addition of quaternary actives to the system the salts separate from solution. Quaternaries lower the system's pH. The increased acidity is thought to cause the salt separation.

The FWA acid forms, though less dissociated, are not readily dispersible in quaternary actives. They are also not water soluble.

Neiditch et al, U.S. Pat. No. 3,904,533, describes a low electrolyte content liquid fabric softener emulsion containing fluorescent whitening agent. To achieve low electrolyte levels, Neiditch requires the use of at least two quaternary compounds. One of these compounds must be a low temperature stabilizing agent.

Simple solutions to the problems of dispersibility and stability of whitening agents in single active cationic systems has eluded researchers in the field till now.

It is an object of this invention to provide a low electrolyte content fabric softener system of satisfactory product viscosity and long term stability containing fluorescent whitening agents.

Another object of the present invention is to provide a method for dispersing fluorescent whitening agents in the quaternary active phase of fabric softener systems.

SUMMARY OF THE INVENTION

A fabric softening and whitening composition comprising:

(i) from about 0.5% to about 10% of a cationic surfactant;

(ii) from about 0.001% to about 0.3% of a stilbene sulfonic acid fluorescent whitening agent;

(iii) from about 0.001% to about 0.5% of a non-ionizable base; and (iv) water.

DETAILED DESCRIPTION OF THE INVENTION

It has been discovered that neutralizing the acid form of a fluorescent whitening agent with a non-ionizable base allows for rapid dispersion of the agent in the quaternary active. Emulsion viscosity and long term stability are not adversely affected.

Liquid rinse cycle softeners are typically emulsions of sparingly soluble quaternary actives dispersed in an aqueous phase. Emulsion structure is formed through the repulsion of similarly charged cationic droplets dispersed uniformly throughout the water phase. Repulsion between like-charged droplets creates a viscous drag. A product viscosity greater than water results from the drag between droplets. Additionally, the electrical forces act to increase the emulsion phase stability. In the absence of charged repulsion, droplets will coalesce forming separate active phases. Addition of electrolyte to the system acts to reduce the effectiveness of repulsive forces separating droplets. Lower product viscosity and inferior storage stability result.

Fabric softener systems of this invention have an emulsion structure of the type discussed above. Electrolyte content must be kept to a minimum. By use of non-ionizable organic bases to neutralize fluorescent whitening agents, we have discovered how to minimize electrolyte content. Yet, non-ionizable bases allow for solubilization of the fluorescent dye.

CATIONIC SURFACTANTS

The fabric softening and whitening compositions of this invention contain the following components either as essential or as optional ingredients: cationic surfactant(s), viscosity control salts, bluing agents, colorants, fluorescent whitening agents, dispersing agents, organic acids for pH control, non-ionizable bases, perfume and preservatives. Each of these components both essential and optional are discussed in greater detail below.

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Quaternary surfactants suitable for the present invention can be chosen from the group consisting of:

(i) non-cyclic quaternary ammonium salts of the formula:

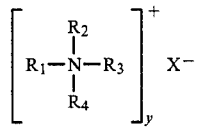

wherein $R_1$ is an alkyl or alkenyl group having from 8 to 22 carbon atoms; $R_2$ is an alkyl group containing from 1 to 3 carbon atoms; $R_3$ and $R_4$ is selected from the group consisting of $R_1$ and $R_2$; X is an anion selected from the group consisting of halides, sulfates, alkyl sulfates having from 1 to 3 carbon atoms in the alkyl chain, and acetates; and y is the valency of X.

The instant class of cationic surfactants is preferred above other types of similar quaternaries. Particularly preferred is dimethyl di-hydrogenated tallow ammonium chloride. This surfactant is sold under the trademark of Adogen 442 by the Sherex Corporation.

(ii) substituted polyamine salts of formula:

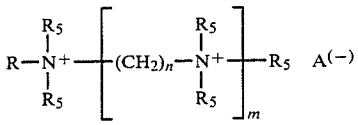

(I)

wherein R is an alkyl or alkenyl group having 10 to 22 carbon atoms, the $R_5$'s which may be the same or different each represent hydrogen, a $(C_2H_4O)_pH$ or $(C_3H_6O)_qH$, or a $C_{1-3}$ alkyl group, where each of p and q is a number such that (p+q) does not exceed 25, m is from 1 to 9, n is from 2 to 6, and $A^{(-)}$ represents one or more anions having total charge balancing that of the nitrogen atoms;

(iii) Polyamine salts having the formula I where R is hydrogen or a $C_{1-4}$ alkyl group, each $R_5$ is hydrogen or a $C_{1-4}$ alkyl group, n is from 2 to 6 and m is not less than 3;

(iv) $C_{8-25}$ alkyl imidazolinium salts; and (v) $C_{12-20}$ alkyl pyridinium salts.

Alkyl imidazolinium salts of class (iv) useful in the present invention are generally believed to have cations of the formula:

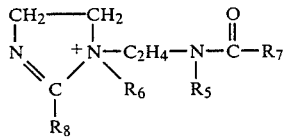

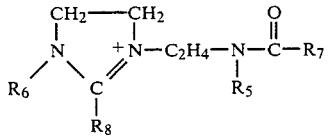

wherein $R_5$ is hydrogen or a $C_1$–$C_4$ alkyl radical, $R_6$ is a $C_1$–$C_4$ alkyl radical, $R_7$ is a $C_9$–$C_{25}$ alkyl radical and $R_8$ is hydrogen or a $C_8$–$C_{25}$ alkyl radical.

A preferred member of this class is believed to have $R_6$ methyl and $R_7$ and $R_8$ tallow alkyl, $R_5$ hydrogen, and is marketed under the trademark Varisoft 475 by the Sherex Chemical Company.

Alkyl pyridinium salts of class (v) useful in the present invention have cations of the general formula:

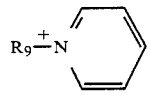

wherein $R_9$ is a $C_{12}$–$C_{20}$ alkyl radical. A typical useful material of this type is cetyl pyridinium chloride.

Mixtures of more than one cationic surfactant may be employed.

In the context of this invention, the broad terms "alkyl" and "alkenyl" are intended to encompass hydrocarbon radicals which are substituted or interrupted by functional groups.

The cationic surfactant may be present from about 0.5 to about 10% by weight of the total aqueous fabric softener system. Preferably, the concentration should range from about 3% to about 8%. Most highly preferred is a cationic level of from about 4% to about 6%.

FLUORESCENT WHITENING AGENTS

Fluorescent whitening agents suitable for use with this invention are derivatives of stilbene sulfonic acid. Particulary preferred are 4,4'-bis[(4-phenylamino-6-N-bis(2-hydroxyethyl)amino-1,3,5-triazin-2-yl)amino]stilbene-2,2'-disulfonic acid, whose chemical structure is outlined as (I) below:

FWA I

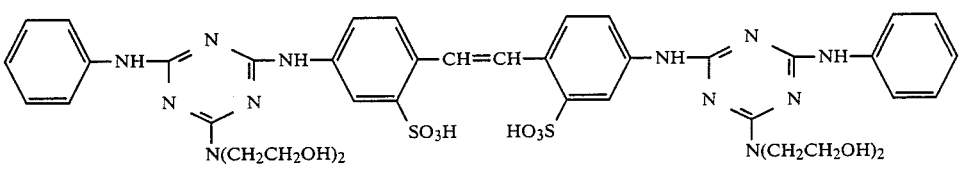

and 5-(2H-naphtho[1,2d]triazol-2-yl)-2-(2-phenylethenyl)-benzene-sulfonic acid, whose chemical structure II is outlined below.

FWA II

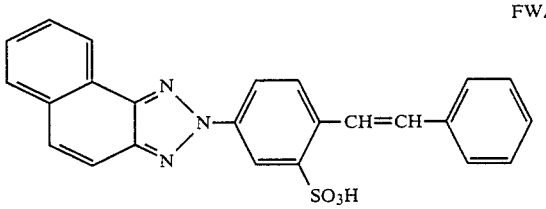

These fluorescent whitening agents may be present at a level from about 0.001% to about 0.3% by weight. Preferably, they should be present at a level from about 0.1% to about 0.2%.

NON-IONIZABLE BASES

Non-ionizable bases suitable for use with this invention include those alkaline agents which do not ionize when dissolved in water. Typical examples of this type include ammonia, alkanolamines, pyridine, pyrrole, pyrrolidine, piperidine, piperazine, morpholine, alkylamines and other organic bases. Alkyl, alkenyl, aryl and alkylaryl derivatives of these nitrogen organic bases are also suitable for use in this invention. For instance, triethylamine, diethylamine, ethylamine, propylamine and butylamine can be utilized.

Particularly preferred are the alkanolamines of structure $R_1R_2R_3N$ wherein $R_1$ is hydroxyalkyl and $R_2$ and $R_3$ are each selected from the group consisting of hydrogen and hydroxyalkyl. The alkyl group may contain from 1 to 24 carbons. Preferred alkanolamines are monoethanolamine, diethanolamine, triethanolamine and mixtures thereof.

Concentration levels for non-ionizable bases may vary from about 0.001% to about 0.5% by weight depending upon the molecular weight of the base and type and level of fluorescent whitening agent used. A preferred weight percent of non-ionizable base is from about 0.05% to about 0.2% when the base used is triethanolamine and the fluorescent whitening agent is of the amino stilbene sulfonic acid type used at a weight percent of 0.1% to 0.2%.

Preferred ratios of non-ionizable base to fluorescent whitening agent are about b 1:1 to about 6:1 based on equivalent weight of base to acid groups. Particularly preferred are ratios of about 2:1 to 6:1. Higher amounts of non-ionizable base to whitening agent can be employed although the effectiveness is not materially enhanced by these higher concentrations of base.

PH ADJUSTING AGENTS

Sometimes it is desirable to use acidic components such as low levels of mineral acids or weak organic acids to adjust pH levels between 3 to 6. Although such pH adjustment is not mandatory, it has been found beneficial in reducing bacterial contamination of the final product. Accordingly, acids such as citric acid, benzoic acid or other weak organic acids are often used for a pH adjustment. Typically, these materials are used at a level of between 0.01% and 0.3% when a pH of 3.0 to 6.0 is desired.

DISPERSING AGENTS

Occasionally, dispersing agents are desirable in the fabric softener formula to aid in rapid dissolution of softener in the rinse water. While dispersing agent is not required, it is helpful. When included, the dispersing agent is typically an ethoxylated nonionic fatty alcohol or acid of chain length $C_{12}$–$C_{25}$ having from 3 to 12 units of ethylene oxide per carbon chain. Typically, dispersing agents are used at a level of between 0.1% and 1.0% when incorporated into these liquid fabric softener compositions.

VISCOSITY CONTROL SALTS

While it is necessary to restrain electrolyte level to maintain high viscosity, sometimes it is desirable to include very low levels of ionizable salts to fine-tune the viscosity level. To effect product viscosity reductions, it can be desirable to incorporate ionizable salts such as the salts derived from reacting mineral acids with strong bases. Typically, sodium chloride could be used for this purpose at a level between 0.001% and 0.05%. Additional ionizable salts acceptable for this purpose include the sodium or potassium neutralized salts of organic acids such as citric or benzoic acids.

MINOR COMPONENTS

Other optional components for use with fabric softeners may be added in small amounts. They enhance either appearance or performance properties. Typical components of this type include, but are not limited to, colorants, bluing agents, preservatives, germicides and perfumes.

The following examples will more fully illustrate the embodiments of this invention. All parts, percentages and proportions referred to herein and in the appended claims are by weight unless otherwise illustrated.

EXAMPLE I

Fabric softening systems of this invention are obtained by separately preparing two mixtures. The main mixture, consists of water and water-soluble components. It is stirred and heated to 135° F.

An organic premix is also prepared and consists of:

(1) the active component, e.g. dimethyl dihydrogenated tallow ammonium chloride, (2) fluorescent whitening agent, (3) non-ionizable base, e.g. triethanolamine, at a minimum 1:1 mole ratio with the fluorescent dye.

The premix is heated and stirred to a minimum of 155° F. until all of the FWA is dispersed. Thereafter, the organic premix is added to the main mix, with sufficient stirring to ensure that the active does not collect on top of the water phase. The resultant mixture is cooled to 100° F. by stirring. Preservative and perfume are then added, along with sufficient water to complete the composition.

EXAMPLE II

A typical formula utilizing the invention is outlined below.

| Blend 1 | |
|---|---|
| Component | Weight % |
| Dimethyl di-hydrogenated tallow ammonium chloride | 5.5 |
| *Triethanolamine | 0.144 |
| FWA-I | 0.144 |
| Citric acid | 0.1 |
| Dyes, perfume, preservative | 0.16 |
| Deionized water | to 100% |

*Ratio on an equivalents basis of non-ionizing base to FWA acid group is 3/1

The above formula exhibited excellent fabric whiteness/brightness.

EXAMPLE III

A fluorescent whitening agent of the type shown in Formula FWA I is readily converted to the salt form by ionizable bases such as sodium hydroxide, thereby becoming dispersible in single active softener systems. The softeners are highly sensitive to electrolyte content. Ions formed by FWA ionizable base neutralization have been found to destabilize the product, causing its viscosity to show a marketed drop over time. The formula below suffers from this instability.

| Blend 2 | |
|---|---|
| Component | Weight % |
| Dimethyl di-hydrogenated tallow ammonium chloride | 5.5 |
| Sodium salt of FWA-I | 0.144 |
| Dyes, perfume, preservative | 0.26 |
| Deionized water (40 μs) | to 100% |

Viscosity-time profiles for the various blends are found in Table 1. Within one month of preparation, the viscosity of Blend 2 decreased substantially. These results with Blend 2 delineate the stability problem experienced with ionizable FWA type I salts. By neutralizing the FWA with a non-ionizing base, excess electrolyte is minimized. As a result, the product demonstrates improved viscosity-time characteristics. For instance, compare Blend 1 to Blend 2 in Table 1.

Neutralization of the FWA requires that a minimum level of one equivalent of non-ionizable base be present for each equivalent of FWA acid group. Lower ratios do not totally disperse the FWA.

| Blend 3 | |
|---|---|
| Component | Weight % |
| Dimethyl di-hydrogenated tallow ammonium chloride | 5.5 |
| *Triethanolamine | 0.06 |
| FWA-I | 0.144 |
| Dyes, perfume, preservative | 0.16 |
| Deionized $H_2O$ | to 100% |

*Ratio on an equivalents basis of non-ionizing base to FWA acid group is 1.3/1

| Blend 4 | |
|---|---|
| Component | Weight % |
| Dimethyl di-hydrogenated tallow ammonium chloride | 5.5 |
| *Triethanolamine | 0.3 |
| FWA-I | 0.144 |
| Citric acid | 0.1 |
| Dyes, perfume, preservative | 0.16 |
| Deionized water | to 100% |

*Ratio on an equivalents basis of non-ionizing base to FWA acid group is 6.5/1

TABLE 1

Viscosity-Time Profile of Various Softeners*

| Formula | 1 day | 1 week | 1 month | % Change at 1 month |
|---|---|---|---|---|
| Blend 1 | 320 | 263 | 318 | 0.6 |
| Blend 2 | 276 | 254 | 188 | 32 |
| Blend 3 | 240 | 228 | 200 | 17 |
| Blend 4 | 370 | 350 | 327 | 12 |

*Viscosity in centipoise, as measured on a Brookfield Model LVF Viscometer, #1 spindle at 12 rpm.

EXAMPLE IV

A wide range of non-ionizable bases have been successfully used in this invention. They disperse the FWA without acting to reduce viscosity in the softener system. Representative examples of these non-ionizable bases can be found in Blends 5–10.

The viscosity-stability of Blends 5 and 6 are shown in Table 2. Although not listed, Blends 7–10 showed similar stability after one month of storage.

| Blends 5–10 | |
|---|---|
| Component | Weight % |
| Dimethyl di-hydrogenated tallow ammonium chloride | 5.5 |
| *Nonionizable base | — |
| FWA-I | 0.144 |
| Citric acid | 0.1 |
| Dyes, perfume, preservative | 0.16 |
| Deionized $H_2O$ | to 100% |

| | *Nonionizable base | Equivalents Ratio Nonionizing Base:FWA |
|---|---|---|
| Blend 5: | 0.06% monoethanolamine | 3:1 |
| Blend 6: | 0.102% diethanolamine | 3:1 |
| Blend 7: | 0.08% triethylamine | 2.2:1 |
| Blend 8: | 0.025% methylamine | 2.2:1 |
| Blend 9: | 0.08% n-Hexylamine | 2.2:1 |
| Blend 10: | 0.04% n-Hexylamine | 1.1:1 |

TABLE 2

Viscosity* vs. Time Characteristics of Various Nonionizable Base-FWA Combinations

| Formula | 1 day | 1 week | 1 month |
|---|---|---|---|
| Blend 5 | 180 | 217 | 195 |
| Blend 6 | 594 | 651 | 510 |
| Blend 11 | 112 | 113 | 103 |

*Viscosity as measured on a Brookfield Model LVF Viscometer; #1 spindle, 12 rpm. Viscosities over 500 cps, use #3 spindle, 30 rpm.

EXAMPLE V

An example of a system using an FWA other than FWA I is that of FWA II, naphthotriazolylstilbene, which is dispersed using triethanolamine at various ratios. Blends 11–14 illustrate this system. Particular component variations and the resultant stability of the FWA are noted in Table 3. Absent or insufficient amounts of TEA afforded unstable compositions wherein FWA II precipitated from the system (see Blends 13 and 14).

| Blends 11–14 | |
|---|---|
| Component | Weight % |
| Dimethyl di-hydrogenated tallow ammonium chloride | 5.5 |
| *Triethanolamine (TEA) | — |
| Naphthotriazolylstilbene type, FWA-II | 0.144 |
| Dyes, perfume, preservative | 0.16 |
| Deionized water | to 100% |

TABLE 3

Triethanolamine/FWA II Systems

| Blend | Equivalent Ratio TEA:FWA II Acid Groups | *Wt. % TEA | FWA Stability |
|---|---|---|---|
| 11 | 1.2:1 | 0.06 | Stable |
| 12 | 2:1 | 0.12 | Stable |
| 13 | 1:3 | 0.015 | FWA Precipitated |
| 14 | No TEA | 0 | FWA Precipitated |

The viscosity profile of Blend 11 is outlined numerically in Table 2 (vide supra). Its stability was excellent.

EXAMPLE VI

Another type of quaternary active suitable for use with this invention are the imidazolinium cationics. A typical formulation is presented by Blend 15.

| Blend 15 | |
|---|---|
| Component | Wt. % |
| *Quaternary actives | 5.5 |
| Triethanolamine (when present) | 0.144 |
| FWA-I | 0.144 |
| Citric Acid | 0.10 |
| Dyes, perfume and preservative | 0.16 |
| Deionized water | to 100% |

The stability of imidazolinium salts (Varisoft 475) and combinations of this with dimethyl di-hydrogenated tallow ammonium chloride were evaluated for stability. Effects of triethanolamine were also evaluated. The results are recorded in Table 4. Varisoft 475 alone or in combination with dimethyl di-hydrogenated tallow ammonium chloride afforded viscosity stable liquids when TEA was present. Absent TEA, the FWA precipitates from the fabric softener system.

TABLE 4

| *Quaternary Active | Triethanolamine | Results |
|---|---|---|
| 5.5% imidazolinium salt (Varisoft 475) | Present | Stable viscosity |
| 5.5% imidazolinium salt (Varisoft 475) | Absent | FWA precipitated |
| 2.75% imidazolinium salt (Varisoft 475) and 2.75% ADT dimethyl dihydrogenated tallow ammonium chloride | Present | Stable viscosity |
| 2.75% imidazolinium salt (Varisoft 475) and 2.75% ADT dimethyl dihydrogenated tallow ammonium chloride | Absent | FWA precipitated |

The foregoing description and examples illustrate selected embodiments of the present invention. In light thereof, various modifications will be suggested to one skilled in the art, all of which are within the spirit and purview of this invention.

What is claimed is:

1. A method for forming a fabric softening system containing fluorescent whitening agents comprising:
   (a) preparing an organic premix of:
      (i) from about 0.5% to about 10% fabric softening cationic surfactant;
      (ii) from about 0.001% to about 0.3% stilbene sulfonic acid fluorescent whitening agent added in acid form;
      (iii) from about 0.001% to about 0.5% of a nonionizable base, the ratio of base to fluorescent whitening agent on an equivalent weight basis being about 1:1 to about 6:1;
   (b) adding said premix to deionized water containing water-soluble adjunct fabric softening components including from 0.01% to 0.3% of an acidic pH adjusting agent to obtain a pH of 3.0 to 6.0; and
   (c) mixing the combined blends with sufficient stirring to uniformly disperse all components.

2. A method according to claim 1 wherein heat is applied in stirring both the cationic blend and the combination of cationic and with aqueous blends.

3. A method according to claim 1 wherein the cationic surfactant has the formula:

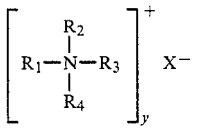

wherein $R_1$ is an alkyl or alkenyl group having from 8 to 22 carbon atoms; $R_2$ is an alkyl group containing from 1 to 3 carbon atoms; $R_3$ and $R_4$ is selected from the group consisting of $R_1$ and $R_2$; X is an anion selected from the group consisting of halides, sulfates, alkyl sulfates having from 1 to 3 carbon atoms in the alkyl chain, and acetates; and y is the valency of X.

4. A method according to claim 1 wherein the cationic surfactants have the formula:

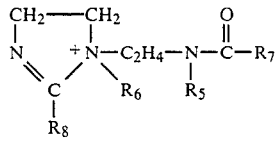

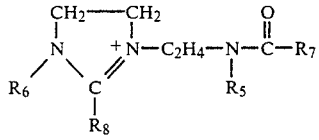

wherein $R_5$ is hydrogen or a $C_1$–$C_4$ alkyl radical, $R_6$ is a $C_1$–$C_4$ alkyl radical, $R_7$ is a $C_9$–$C_{25}$ alkyl radical and $R_8$ is hydrogen or a $C_8$–$C_{25}$ alkyl radical.

5. A method according to claim 4 wherein $R_6$ is methyl, $R_7$ and $R_8$ are tallow alkyl and $R_5$ is hydrogen.

6. A method according to claim 1 wherein the cationic surfactant is a mixture of non-cyclic quaternary ammonium salt and imidazolinium salts.

7. A method according to claim 1 wherein the fluorescent whitening agent is either 4,4'-bis[(4-phenylamino-6-N-bis(2-hydroxyethyl)amino-1,3,5-triazin-2-yl)amino]stilbene-2,2'-disulfonic acids or 5-(2H-naphtho[1,2d]triazol-2-yl]-2-(2-phenylethenyl)-benzene-sulfonic acid.

8. A method according to claim 1 wherein the nonionizable base is chosen from the group consisting of ammonia, alkanolamine, pyridine, pyrrole, pyrrolidone, piperidine, piperazine, morpholine, alkylamines and mixtures thereof.

9. A method according to claim 8 wherein the nonionizable base is an alkyl, alkenyl, aryl or alkylaryl derivative of the bases in claim 8.

10. A method according to claim 1 wherein the nonionizable base is a mono-, di- or tri-alkylamine, the alkyl group being $C_1$–$C_{24}$.

11. A method according to claim 1 wherein the nonionizable base is selected from the group consisting of monoethanolamine, diethanolamine, triethanolamine and mixtures thereof.

12. A method according to claim 1 wherein the cationic surfactant is dimethyl dihydrogenated tallow ammonium chloride.

13. A method according to claim 1 wherein the acid pH adjusting agent is citric acid.

* * * * *